United States Patent [19]

Gray

[11] 4,020,601

[45] May 3, 1977

[54] GRINDER WITH WEAR COMPENSATING TOOL REST

[76] Inventor: Robert C. Gray, 280 Clifford St., Blackfoot, Idaho 83221

[22] Filed: July 7, 1975

[21] Appl. No.: 593,330

[52] U.S. Cl. ..... 51/238 R; 51/134.5 R; 51/165.72; 51/165.87

[51] Int. Cl.[2] ..... B24B 41/06

[58] Field of Search ..... 51/238 R, 238 T, 165.87, 51/165.88, 165.92, 165.77, 134.5 R

[56] References Cited

UNITED STATES PATENTS

| | | | |
|---|---|---|---|
| 1,032,686 | 7/1912 | Kundig | 51/165.87 |
| 2,986,854 | 6/1961 | Ross | 51/165.87 |
| 3,090,171 | 5/1963 | Stimson | 51/165.92 X |
| 3,250,043 | 5/1966 | Finkl | 51/134.5 R |
| 3,782,046 | 1/1974 | Schaap | 51/238 R |

*Primary Examiner*—Harold D. Whitehead

*Attorney, Agent, or Firm*—Richard F. Bojanowski

[57] ABSTRACT

An electrically operated grinding wheel is described wherein the grinding wheel is adapted with a slidable tool rest member which will automatically position itself at a preselected distance from the grinding wheel. As the grinding wheel becomes worn and its wheel diameter decreased, the slidable tool rest member will be automatically moved towards the grinding wheel and a safe operational spacing between the grinding wheel and the tool rest member maintained. This is achieved through a motorized gear train which is actuated by a photoelectric cell carried within the housing of the tool rest member. Another feature is that as the wheel is worn and approaches a preselected minimum diameter, a switch is automatically actuated which will turn off the power to the grinding wheel preventing its operation until such time that the worn grinding wheel is replaced.

8 Claims, 4 Drawing Figures

GRINDER WITH WEAR COMPENSATING TOOL REST

BACKGROUND OF THE INVENTION

This invention is directed to a grinding wheel and particularly to a grinding wheel which contains an automatically adjustable support plate or tool rest member.

Grinding wheels are regularly employed for removing burrs from work pieces, for sharpening tools, for polishing metal and the like. Most every manufacturing company has at least one grinding wheel available for use by its employees. Grinding wheels currently in use are generally of the type having a manually adjustable tool rest member as depicted on the right-hand side of FIG. 1.

One or two grinding wheels are fixed at each end of a rotatable shaft operatively connected to an electric motor. A tool rest member is mounted in front of the grinding wheel to provide a firm base upon which a work piece can be rested during the grinding operation. As shown on the right-hand side of FIG. 1, the tool rest member is of the type which can be manually adjusted and slidably moved towards the grinding wheel by loosening a set screw affixed to the base thereof. As the grinding wheel becomes worn and its size reduced, the set screw is loosened and the tool rest member is manually moved towards the grinding wheel. It is essential that the tool rest member be positioned as close to the grinding wheel as is possible to prevent the work piece from being drawn into the space between the grinding wheel and the tool rest member. If the work piece is forced into the space between the grinding wheel and the tool rest member, the operator can lose control of the work piece and, in all probability, damage either the work piece or the grinding wheel.

Although adjustment of the tool rest member requires very little time and effort, it has been found that most users will generally attempt to use the grinding wheel without first adjusting the tool rest member. Even if the tool rest member is readjusted, it is usually done in a hurried fashion and, as a result, may be improperly done. As the grinding wheel becomes worn from continuous use, the space between the edge of the grinding wheel and the tool rest member increases. As pointed out above, when this occurs the use of the grinding wheel can become dangerous and can cause irreparable injury to the work piece, the grinding wheel or the operator. As the space between the grinding wheel and the tool rest member is increased, the possibility that the work piece will be forced into the space is substantially increased. Although damage to the work piece and the grinding wheel is most likely, missile-like fragmentary pieces from the damaged work piece or from the grinding wheel can be released and cause permanent injury to the operator.

In addition to the dangers above mentioned, most grinding wheels are constructed such that the inner part or section of the wheel does not possess the same degree of hardness as does the outer section. Thus, when the wheel becomes worn and approaches the softer inner section, it should be replaced. Most grinding wheel manufacturers indicate this point on the grinding wheel by placing a circular label along the side of each face of the grinding wheel. Instructions are provided by the manufacturer which state in effect that the use of a grinding wheel should be discontinued before the wheel reaches this minimum diameter. In many cases, an operator will attempt to use the grinding wheel just one more time before changing the wheel. In so doing, the possibility of injury to the operator is substantially increased.

In order to avoid the problem areas above-mentioned it is a primary object of this invention to provide a grinding wheel and tool rest member which will automatically maintain an optimum safe distance between the grinding wheel and tool rest member. Another object of this invention is to provide a grinding wheel which is adapted with a sensing means which will automatically move the tool rest member toward the grinding wheel as the wheel becomes worn and thereby maintain a proper and safe spacing therebetween.

Still another object of this invention is to provide an automaticc cut-off switch which will terminate power to the grinding wheel whenever the wheel becomes worn and approaches its critical minimum diameter.

SUMMARY OF THE INVENTION

The instant invention comprises generally a grinding wheel rotatably mounted to a base support member. An automatically adjustable tool rest member is slidably held to a tool rest housing mounted to to the base support member. A means is also provided for sensing changes in distance that the tool rest member is from the grinding wheel and in response thereto for automatically moving the tool rest member towards the grinding wheel. A means is also provided to automatically terminate power to the grinding wheel whenever the grinding wheel reaches its critical predetermined minimum diameter.

DESCRIPTION OF THE PREFERRED EMBODIMENT

Figure 1:
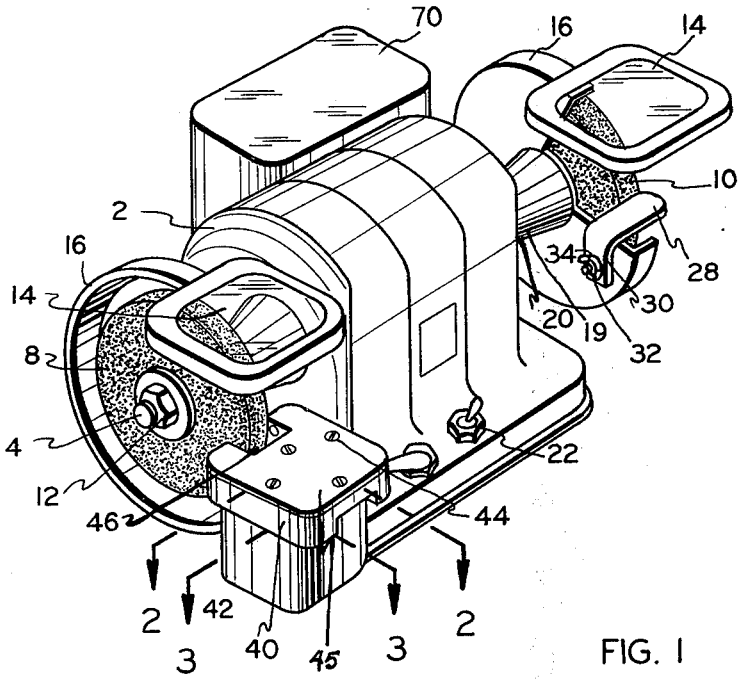
FIG. 1 is a three-dimensional view of a grinding wheel wherein the left-hand side depicts an embodiment of this invention and the right-hand side depicts a grinding wheel equipped with a conventional tool rest member.

A reference is now made to FIG. 1 wherein the grinding wheel of this invention is shown to include a pair of threaded shafts 4 extending axially outwardly from an electric motor (not shown) enclosed within a motor housing 2. A pair of grinding wheels, identified generally by numerals 8 and 10, respectively, are carried one on each end of the shafts 4 and secured thereto by threaded locking nuts 12. Each wheel is provided with a transparent protective viewing shield 14 for shielding the operator from sparks or dislodged particles during operation. The viewing shields 14 are pivotally mounted to the forward end of a grinding wheel guard member 16 which surrounds a major portion of each grinding wheel. The guard members 16 are fixed in position through flared cone connecting members 19 which circumscribe shafts 4 emanating from the motor housing 2 at or near point 20. The grinding wheel's electric motor is turned on and off by means of a manually operated switch 22 mounted located at or near the base of the motor housing 2.

Referring now to the wheel depicted on the right-hand side of FIG. 1, the grinding wheel 10 is equipped with a conventional tool rest member 28. This tool rest member 18 is bent at an angle of 90° to provide a leg 30 which is adjustably fixed within a longitudinal slot 34 cut in the lower section of the wheel guard member 16. The tool rest member is secured in position with a wing nut and threaded bolt 32. As the wheel becomes worn, the wing nut is loosened and the tool rest member moved closer towards the wheel. When the tool rest member is properly positioned from the grinding wheel, the wing nut is tightened. One of the problems with this type of assembly is that as the wheel becomes worn the tool rest member 28 must be manually loosened and moved towards the grinding wheel in order to insure that the grinding wheel is maintained at a proper and safe distance from the tool rest member. To overcome the need for manually adjusting the tool rest member, the embodiment shown on the left-hand side of FIG. 1 is provided.

As shown in FIG. 1, a cover plate 45 is fixed to a slidable tool rest member 40 by recessed screws 44 passing through openings bored through the tool rest plate 45. The cover which is slidably held to the member 40 housing member 42 is designed with a cut-out forward section 46 for receiving the outer peripheral edge of the rotating grinding wheel 8.

Figure 2:
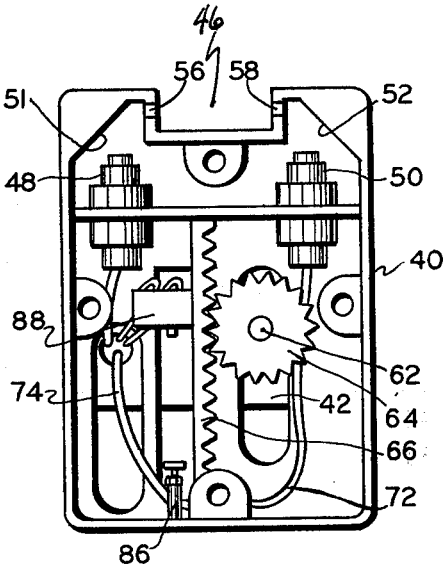
FIG. 2 is a top plan view taken along line 2—2 of FIG. 1 of the slidable tool rest member.

As shown in FIG. 2, the tool rest member 40 contains a photoelectric cell 48 mounted along one of its sides and a matched silicon photo transistor 50 mounted along its other side. The beam from the photelectric cell is emitted forwardly and deflected by a polished or mirrored surface 51. The beam is further deflected by a second mirrored surface 52 which directs the beam towards the photo transistor 50. Each of the polished or mirrored surfaces is mounted at an angle of approximately 45° to provide an angle of deflection of about 90°. The beam passes laterally from the tool rest member 40 through opposing apertures 56 and 58 bored into the recessed or cut-out section 46 of the housing member 42. Under proper spacing conditions, the grinding wheel will obstruct the photoelectric beam disconnecting the electrical circuit controling movement of the tool rest member. However, as the wheel becomes worn the continuity of the circuit is completed causing the relay system to close and activate the electrical motor 60 contained within the housing member 42. Upon activation of motor 60, the tool rest member 40 is slidably moved towards the grinding wheel. Movement continues until such time that the grinding wheel once again intercepts the photoelectric beam emitted from the photoelectric cell 48. Activation of motor 60 causes operatively connected shaft 62 and fixed rotary gear 64 to rotate. Engagement of rotating rotary gear 64 with rack gear 66 moves the rack gear linearly. Since the tool rest member is fixed to the gear, the resulting linear movement is transferred to the tool rest while the tool rest housing member remains stationary. The photoelectric cell 48 and the photo transistor 50 are electrically connected to a power supply and relay system shown in FIG. 4 by the numeral 70 through connecting lines 72 and 74, respectively (FIG. 2). The connecting lines 72 and 74 are of sufficient length so that the tool rest member can be moved forward or retracted without hindrance of any type.

Figure 3:
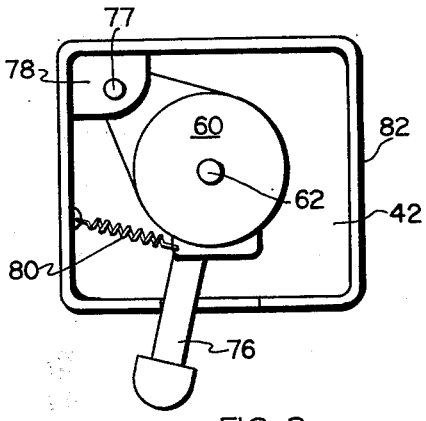
FIG. 3 is a top plan view taken along line 3—3 of FIG. 1 showing the means employed for disengaging the motorized rotary gear extending into the slidable tool rest member.

As shown in FIGS. 2 and 3, the rotary gear 64 may be disengaged from the rack gear 66 by physically moving spring loaded arm 76. Movement of arm 76 moves the motor 60, shaft 62 and gear 64 pivotally about rod 77 fixed to a brace member 78 and disengages rotary gear 64 from rack gear 66. To provide proper engagement between gears 64 and 66, the motor is held in a biased or engaging position by means of a spring 80 connected at one end to the side wall of housing 82 and the other end connected to a segment of the lever member 76.

In order to terminate power to the electrical motor carried within motor housing 2 whenever the grinding wheel reaches a certain minimum diameter, a stationary cut-off switch 88 is provided within the tool rest housing member 42. Actuation of electrical switch 88 is achieved by movement of the tool rest member 40. As the tool rest member moves forward toward the grinding wheel, the electrical switch 88 is contacted by the stop member 86 cutting off the input power to the motor carried within motor housing 2.

Figure 4:
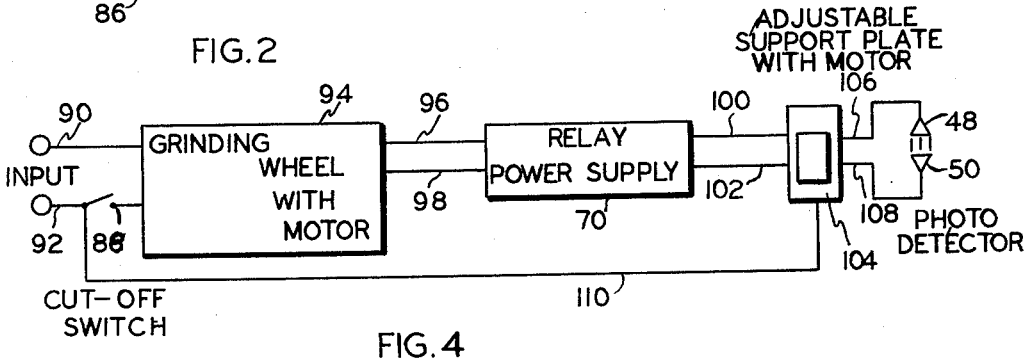
FIG. 4 is a block diagram of a control circuit used in the embodiment of this invention.

As shown in FIG. 4, the power input to the grinding wheel and its motor is achieved through lines 90 and 92, respectively. The cut-off switch earlier identified by numeral 88 intercepts power input line 92. The grinding wheel and motor depicted by numeral 94 is connected to a power supply and relay system identified by numeral 70 through lines 96 and 98. The output from the relay and power supply 70 is carried to the slidable tool rest member, its housing and its motor through lines 100 and 102. The adjustable support plate and motor is depicted in FIG. 4 by the numeral 104. The photoelectric cells and photo transistors are identified by numerals 48 and 50, respectively and are connected to the motor housed within the tool rest housing through lines 106 and 108 and bypass line 110.

The photoelectric cells herein described may be of any conventional design and are readily available on the commercial market. A device which has proven to be particularly acceptable is a system produced by Skan-A-Matic Corporation located in West Elbridge, New York. The miniature photoelectric cells and photo transistors are identified by numbers L33007 and P33001, respectively. The photoelectric cell is subminiature in size and is designed for use under severe vibrating conditions. The photoelectric cells are adapted with a light emitting diode and a matched silicon photo transistor which are mounted within a strong aluminum housing. The diode is adapted with a lens system which efficiently directs IR energy from the photoelectric cell to the silicon photo transistor. The photo transistor contains a lens adapted to gather or receive the IR energy transmitted by the light emitting diode.

The light emitting diode and the photo transistor is electrically connected to a photoelectric control system comprising generally a relay and d.c. power supply means. A suitable relay and d.c. power supply system is available commercially through Skan-A-Matic Corporation and identified generally by stock numbers R330D and T330D, respectively. This system provides lamp power, as well as photo detector excitation.

Although a particular type of photoelectric system has been defined hereinabove, most any sensing and recording device capable of reporting changes in wheel diameter of about 0.1 inch may be used.

Although certain modifications and adaptions of the preferred embodiment hereinabove described may be made by those having ordinary skill in the art, the invention is to be limited only by the claims hereinafter submitted.

I claim:

1. A grinding wheel device comprising:

a. a base support member, b. a grinding wheel rotatably mounted to said base support member, c. a electrical power means for rotating said grinding wheel, d. a tool rest housing having a slidable top tool rest member held thereto, said tool rest housing being stationarily fixed to said base support member, e. a photoelectric sensing and signal emitting means contained within said slidable top tool rest member for continually detecting the distance that said slidable top tool rest member is from said grinding wheel, f. a means for moving said slidable top tool rest member towards said grinding wheel in response to the signal emitted by said photoelectric sensing and signal emitting means whenever the distance between said grinding wheel and said slidable top tool rest member exceeds a predetermined maximum limit and g. a means for automatically disconnecting said electrical power means whenever said grinding wheel becomes worn to a preselected minimum diameter.

2. The grinding wheel device in claim 1 wherein said photoelectric sensing and signal emitting means is a photoelectric cell in combination with a photo transistor.

3. The grinding wheel device of claim 1 wherein the means for automatically disconnecting said electrical power means whenever said diameter of said wheel is reduced to a preselected minimum diameter is an on-off switch energized by movement of said tool rest member.

4. The grinding wheel device of claim 3 wherein said tool rest member is moved towards said grinding wheel by an electric motor operatively connected to a gear train.

5. The grinding wheel device of claim 4 wherein said gear train is a rotable rotary gear connected to said electric motor and a fixed rack gear and wherein said rotary gear and said electric motor are pivotally mounted to permit disengagement of said rotary gear from said rack gear.

6. A device for use in combination with a grinding wheel comprising a lower housing member and a top tool rest member slidably fixed thereto, said top tool rest member having a forward cut out section for receiving the outer circumferential portion of a grinding wheel, a motorized shaft extending upward from said lower housing member and into said top tool rest member and having a rotary gear thereon, a rack gear fixed to said top tool rest member and in engageable contact with said rotary gear and a photoelectric system carried within said top tool rest member to energize said motorized shaft under preselected conditions and thereby slidably move said tool rest member.

7. The device of claim 6 wherein said motorized shaft and rotary gear are pivotally mounted to said housing member and urged into engagement with said rack gear by a bising means.

8. The device of claim 7 wherein said photoelectric system includes a photoelectric cell, a silicon photo transistor and a pair of mirrors for directing a light beam emitted from said photoelectric cell across said forward cut out section and toward said silicon photo transistor.

* * * * *